United States Patent [19]

Watanabe et al.

[11] Patent Number: 4,769,075

[45] Date of Patent: Sep. 6, 1988

[54] BINDER FOR MANUFACTURE OF PRECISION CASTING MOLD

[75] Inventors: Yoshitane Watanabe; Akira Kitajima; Keiko Tasaki, all of Funabashi; Yoshiro Hayashi; Isamu Yuuki, both of Toyota, all of Japan

[73] Assignees: Nissan Chemical Industries, Ltd., Tokyo; Toyota Jidosha Kabushiki Kaisha, Aichi, both of Japan

[21] Appl. No.: 78,653

[22] Filed: Jul. 28, 1987

[30] Foreign Application Priority Data

Jul. 29, 1986 [JP] Japan ..... 61-177942

[51] Int. Cl.[4] ..... B28B 7/36; B28B 7/28; G09K 3/00

[52] U.S. Cl. ..... 106/38.2; 106/38.35; 106/287.16; 106/287.19; 528/9; 528/10; 528/19; 164/24

[58] Field of Search ..... 106/287.16, 287.19, 106/38.35, 38.2; 556/56; 528/10, 9, 19; 164/26

[56] References Cited

U.S. PATENT DOCUMENTS

| | | | |
|---|---|---|---|
| 2,935,522 | 5/1960 | Samour | 556/56 |
| 2,991,299 | 7/1961 | Gmietanski | 556/56 |
| 3,314,806 | 4/1967 | Emblem et al. | 106/38.2 |
| 3,894,572 | 7/1975 | Moore | 164/26 |
| 3,920,578 | 11/1975 | Yates | 252/313 S |
| 4,080,214 | 3/1978 | Wilhelm | 106/38.35 |
| 4,159,204 | 6/1979 | Dittrich et al. | 106/38.35 |
| 4,204,872 | 5/1980 | Hayati et al. | 106/38.35 |
| 4,211,567 | 7/1980 | Dittrich et al. | 106/38.35 |
| 4,396,430 | 8/1983 | Matalon | 106/38.35 |
| 4,522,958 | 6/1985 | Das et al. | 523/212 |

*Primary Examiner*—Theodore Morris
*Attorney, Agent, or Firm*—Parkhurst & Oliff

[57] ABSTRACT

A binder for manufacture of a precision casting mold comprising a transparent solution containing an alkyl orthosilicate or an alkyl polysilicate having a polymerization degree of 2 to 10, and an amino-alkoxide of a metal selected from a group consisting of titanium, zirconium, tin and aluminum or a mixture thereof in the mol ratio (Si/N) of 0.01 to 1.0 calculated in terms of the silicon atom contained in the silicate and the basic nitrogen atom contained in the amino-alkoxide. This binder is excellent in preservation stability and workability and does not dissolve the surface of a water-soluble pattern.

8 Claims, No Drawings

BINDER FOR MANUFACTURE OF PRECISION CASTING MOLD

BACKGROUND OF THE INVENTION

The present invention relates to an improvement of a binder for the formation of a coat layer which is used in a method of manufacturing a mold composed of the steps of forming a refractory coat layer on a mold pattern (hereinunder referred to as "pattern"), removing the pattern, and firing the refractory layer to obtain a desired mold.

The refractory coat layer is generally formed on the pattern as an accumulative refractory coat layer by repeating a process comprising the steps of coating the pattern with a liquid binder or a mixture slurry consisting of the liquid binder and a refractory powder, sanding the coat layer with refractory particles, and drying and hardening the coat layer until a desired thickness is obtained for an accumulative layer.

As the pattern used in the above-described process, a urea pattern, which is water-soluble, has both high strength and high dimensional stability and, in addition, is inexpensive, is desirable. As the binder used in the above-described process, a binder which does not attack a urea pattern when it comes into contact therewith is desired.

As binders obtained by improving binders such as a binder obtained by the hydrolysis of ethyl silicate with an acid and a binder obtained by adding amine to ethyl silicate, Japanese Patent Publication No. 22929/1979 discloses a binder obtained by mixing a polyethyl silicate, an amino group-containing organofunctional hydrophilic silicon compound such as γ-aminopropylethoxysilane, and a non-polar solvent such as xylene in a specific ratio, and a binder obtained further mixing said binder with an alcoholate of titanium, zirconium, aluminum, etc. in a specific ratio.

A binder obtained by the hydrolysis of ethyl silicate with an acid is poor in preservation stability and, in addition, when it comes into contact with the surface of a water-soluble pattern such as a urea pattern, the binder dissolves the surface of the pattern and attacks it, thereby disadvantageously lowering the precision of the mold obtained by the above-described process.

On the other hand, a binder obtained by adding amine to ethyl silicate is good in preservation stability in a hermetic state, but when it comes into contact with the surface of a water-soluble pattern such as a urea pattern, the binder is also apt to attack the surface of the pattern due to the presence of amine in the binder. Furthermore, while a coat layer is formed on a pattern, this binder emits an odor of amine, thereby exerting a deleterious influence on the working atmosphere. In addition, the binder which has been preserved in a container is apt to increase in viscosity or gel while it is used in an open state.

The binder which is disclosed in Japanese Patent Publication No. 22929/1979 and which contains no metal alcoholate does not emit an odor of amine and has a considerably low degree of surface attack on a water-soluble pattern such as a urea pattern and a good preservation stability in a hermetic state, but since the binder in a container comes into contact with air in an open state when forming a mold, its properties are changed after about one-week use; for example, a considerable change in the viscosity is observed. The binder which is disclosed in Japanese Patent Publication No. 22929/1979 and which contains a metal alcoholate shows a considerably good but still insufficient stability while it is used in contact with air in an open state. Furthermore, since a change in properties is caused even during preservation in a hermetic state and the hardening speed thereby changes, it is difficult to set the hardening speed, which is an important factor in forming a mold.

SUMMARY OF THE INVENTION

Accordingly, it is an object of the present invention to provide a binder for manufacture of a precision casting mold which has an adequate bond strength required as a binder for manufacture of a mold, and which has excellent preservation stability and workability.

It is another object of the present invention to provide a binder for manufacture of a precision casting mold which is excellent in preservation stability in a hermetic state, which is unlikely to increase in viscosity or gel during use in an open state, and which is capable of forming a uniform hardened composite.

It is still another object of the present invention to provide an alkyl silicate binder for manufacture of a mold which does not dissolve the surface of a water-soluble pattern and which does not emit a bad odor.

It is a further object of the present invention to provide a method of manufacturing a precision casting mold by using such a binder.

To achieve this aim, a binder according to the present invention contains alkyl silicate, and an amino-alkoxide of a metal such as titanium, zirconium, tin and aluminum.

DESCRIPTION OF THE PREFERRED EMBODIMENTS

More specifically, a binder according to the present invention is characterized in that it is composed of a transparent solution containing a mixture of an alkyl orthosilicate or an alkyl polysilicate having a polymerization degree of 2 to 10, and an amino-alkoxide of a metal selected from a group consisting of titanium, zirconium, tin and aluminum or a mixture thereof in the mol ratio (Si/N) of 0.01 to 1.0 calculated in terms of the silicon atom contained in the silicate and the basic nitrogen atom contained in the amino-alkoxide.

The amino-alkoxides of these metals may be used in the form of a mixture.

The alkyl silicate used in the present invention is an alkyl ester of an orthosilicate or a polysilicate having a polymerization degree of about 2 to 10 or a mixture thereof. As an example of the alkyl groups, a lower alkyl group having a straight chain or a branched chain will be cited. Examples of the alkyl silicates are therefore orthosilicates such as methyl orthosilicate, ethyl orthosilicate, isopropyl orthosilicate and butyl orthosilicate, and ethyl polysilicate, which is known as a trade name of "Ethyl Silicate 40".

The metal amino-alkoxide used in the present invention has a structure in which the alkoxy group of the corresponding metal alkoxide is substituted by at least one amino-alkoxy group in the molecule. As examples of the amino-alkoxy groups, monovalent amino-alkoxy groups having the following chemical formulas:

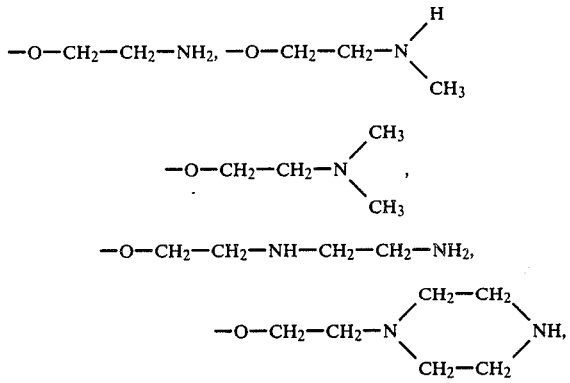

etc., bivalent amino-alkoxy groups having the following chemical formulas:

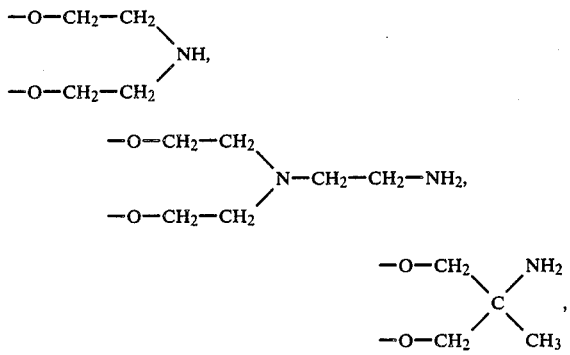

etc., and trivalent amino-alkoxy groups having the following chemical formulas:

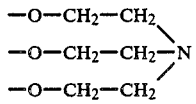

etc. will be cited. As a metal amino-alkoxide, if an amino-alkoxide of titanium is cited as a typical example, those represented by the following chemical formulas will be mentioned:

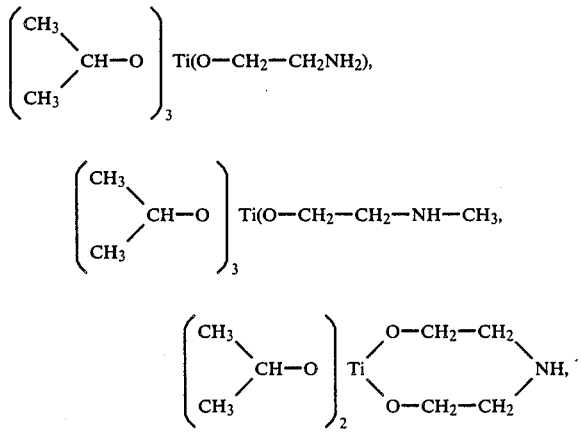

etc. These metal amino-alkoxides are easily obtained by adding an amino-alcohol to an alkoxide of titanium, zirconium, tin or aluminum for effecting ester exchange reaction.

As the alkoxide of titanium, zirconium or tin, a tetraalkoxide will be cited which is easily brought into ester exchange reaction with an amino-alcohol, and which contains four alkoxy groups, per molecule, having 1 to 8, preferably 1 to 4 carbon atoms. Preferred examples are the tetramethoxides, tetraethoxides, tetraisopropoxides and tetrabutoxides of these metals. As the alkoxide of aluminum, a trialkoxide will be cited which is easily brought into ester exchange reaction with an amino-alcohol, and which contains three alkoxy groups, per molecule, having 1 to 8, preferably 1 to 4 carbon atoms. Preferred examples are the trimethoxide, triethoxide, triisopropoxide and triisobutoxide of aluminum.

The amino-alcohols used in the present invention are, for example, monoethanolamine, diethanolamine, triethanolamine, monoisopropanolamine, diisopropanolamine, triisopropanolamine, N-methylethanolamine, N-ethylethanolamine, N-n-butylethanolamine, N,N-dimethylethanolamine, N,N-diethylethanolamine, N,N-dibutylethanolamine, N-(2-aminoethyl)ethanolamine, N-(2-hydroxyethyl)piperazine, aminoethyldiethanolamine, N-methyl-N,N-diethanolamine, and 2-amino-2-methyl-1,3-propanediol.

The metal-alkoxide preferably contains a total of not more than 6 oxygen atoms and nitrogen atoms in one molecule. Preferred examples thereof are triisopropoxy(N-methylethanolaminato)titanium represented by the formula $(i\text{-}C_3H_7O)_3TiOCH_2CH_2NHCH_3$, bisdiethanolaminatozirconium represented by the formula

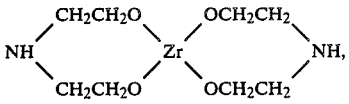

triisopropoxy[N-(2-aminoethyl) ethanolaminato]-titanium represented by the formula $(i\text{-}C_3H_7O)_3Ti\text{-}OCH_2CH_2NHCH_2CH_2NH_2$, diisopropoxybis(isopropoxyaminato)titanium represented by the formula

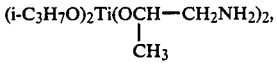

triethanolaminatoaluminum represented by the formula

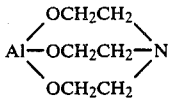

bisdiethanolaminatotitanium represented by the formula

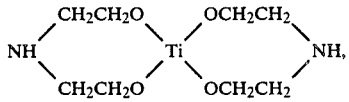

diisopropoxy(diethanolaminato)titanium represented by the formula

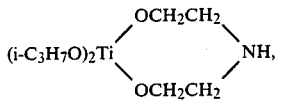

and triisopropoxy(ethanolaminato) titanium represented by the formula $(i\text{-}C_3H_7O)_3Ti\text{-}OCH_2CH_2NH_2$.

A binder according to the present invention is easily obtained as a uniform transparent solution by mixing the abovedescribed metal amino-alkoxide with the above-described alkyl silicate. So long as the object of the present invention is achieved, any other component may be added to the above-described components. In some cases, a preferred binder is obtained by adding, for example, a solvent of an aromatic hydrocarbon such as xylene, toluene and benzene, an aliphatic hydrocarbon such as hexane and heptane, an alcohol such as methanol, ethanol, propanol and butanol or an ether such as ethylene glycol monoethyl ether.

Furthermore, since an alkoxide of titanium, zirconium, tin or aluminum is easily brought into ester exchange reaction with amino-alcohol in the above-described alkyl silicate, thereby generating an amino-alkoxide of such a metal and an alcohol, the above-described alkyl silicate which is mixed with an alkoxide of tittanium, zirconium, tin or aluminum and an amino-alcohol and thoroughly stirred may also be used as a binder of the present invention. In this case, however, it is necessary that the amount of amino-alcohol to be added is not more than the stoichiometric amount so that there is no amino-alcohol remaining unreacted.

The mixing ratio of an alkyl silicate and a metal amino-alkoxide for preparing a binder of the present invention is preferably so adjusted that the basic nitrogen atom contained in the metal amino-alkoxide is 0.01 to 1.0 mol, preferably 0.03 to 0.5 mol per mol of the silicon atom contained in the alkyl silicate.

When a mold is formed on a water-soluble pattern such as a urea pattern, it is preferable to use a binder further containing about 50 to 300 wt % of a non-polar solvent such as xylene based on the alkyl silicate.

Since the above-described amino-alkoxide of titanium, zirconium, tin, aluminum, or the like is stable in the alkyl silicate, a binder of the present invention does not deteriorate and exhibits a constant hardening speed, so long as it is preserved in a hermetic state. The metal amino-alkoxide not only acts on the alkyl silicate as a hydrolysis catalyst but also hydrolyzes itself, thereby taking a share in the bonding strength.

Since the activity of the metal amino-alkoxide as a hydrolysis catalyst is lower than that of the amino-alcohol, and the hydrolyzing speed thereof is lower than the corresponding metal alkoxide which does not contain an amino group, when a binder of the present invention is dried on a pattern while absorbing water, the initial hydrolyzing speed is low, but the speed increases with the elapse of time. Thus, the metal amino-alkoxide performs an important function in forming a favorably hardened body. The metal amino-alkoxide also makes it unlikely that a binder in a container increases in viscosity or gels while it is used in an open state in which a relatively small rate of water absorption occurs. Furthermore, the metal amino-alkoxide facilitates the formation of a uniform hardened composite when it is hardened together with the alkyl silicate. The uniformity is supposed to be brought about by the occurrence of a large amount of titanosiloxane bond.

The reason why the activity of the metal amino-alkoxide as a hydrolysis catalyst is low and the hydrolyzing speed thereof is low is considered to be that, in the metal aminoalkoxide, the nitrogen atom forms a coordinate bond with the metal atom in a molecule and exists as a stable intramolecular complex compound, as described at pp. 226 to 241 of "METAL ALKOXIDE" by D. C. Bradley, R. C. Mehrotea, and D. P. Gaur, published by Academic Press, London (1978), hence the presence of the coordinate bond greatly lowers the basicity of the nitrogen atom.

Furthermore, the fact that binders of the present invention do not attack a water-soluble pattern such as a urea pattern and do not emit an odor of amine while being dried and hardened on the pattern is considered due to the reason that the formation of an amino-alcohol by the hydrolysis of the metal amino-alkoxide is suppressed at the initial stage of drying when the solvent evaporates vigorously and accordingly, almost no amino alcohol exists in the solvent.

A mixture of an alkyl silicate, a metal amino-alkoxide and a non-polar solvent such as xylene, which is a preferred binder of the present invention, has an appropriate viscosity and solid concentration for a good workability, does not corrode the surface of a pattern, in particular, a water-soluble pattern at all, and enables more than one-week use without any change in properties in an open state.

A binder containing an alkyl silicate and a metal amino-alkoxide in the ratio of 0.03 to 0.5 mol of the basic nitrogen atom in the amino-alkoxide per mol of the silicon atom in the alkyl silicate, which is a preferred binder of the present invention, shows a particularly favorable hardening speed.

EXAMPLE 1

284 parts by weight of tetraisopropoxy titanium were added to 1,500 parts by weight of xylene under stirring at normal temperature, and 75 parts by weight of N-methylethanolamine and 1,500 parts by weight of Ethyl Silicate 40 were subsequently added to the mixture to obtain a binder (A).

The binder (A) was applied to a glass plate and dried while left in the air of a temperature of 25° C. and a relative humidity (RH) of 60% for 40 minutes, whereby a firmly gelled transparent film was formed on the glass plate.

5,000 parts of weight of Zircon Flour #350 were mixed with 1,000 parts by weight of the binder (A) to prepare a slurry ($A_1$), and 4,800 parts by weight of Zircon Flour #200 were mixed with 1,000 parts by weight of the binder (A) to prepare a slurry ($A_2$).

A water-soluble urea powder was heated and molten at 150° to 170° C. and poured into a metal mold to form a water-soluble pattern having a width of 20 mm, a length of 100 mm and a thickness of 10 mm. A stucco material for sanding were then prepared. The pattern was first dipped in the slurry ($A_1$), then taken out to be sanded, and dried to form a first coat layer. The pattern with the first coat layer formed thereon was dipped in the slurry ($A_2$), taken out to be subjected again to sanding, and then dried to form a second coat layer. By repeating this process, third to sixth coat layers were formed by using the slurry ($A_2$) and were accumulated in that order. The last layer, namely, a seventh layer was taken out after being dipped in the slurry ($A_2$) and directly dried without being subjected to sanding. Thus, an accumulative coat layer was formed on the pattern.

The stucco materials used in the sanding steps and the drying conditions in the process of the formation of the accumulative coat layer are shown in Table 1.

TABLE 1

| Accumulative Layer No. | Stucco Material | Drying Condition Temperature (°C.) | Relative Humidity (%) | Time (H) |
|---|---|---|---|---|
| 1 | Zircon Sand #80 | 25 | 60 | 3 |
| 2 | Zircon Sand #80 | 25 | 60 | 3 |
| 3 | High alumina sand (particle diameter: 0.5 mm) | 25 | 60 | 3 |
| 4 | High alumina sand (particle diameter: 0.5 mm) | 25 | 60 | 3 |
| 5 | High alumina sand (particle diameter: 0.7 to 1.0 mm) | 25 | 60 | 3 |
| 6 | High alumina sand (particle diameter: 0.7 to 1.0 mm) | 25 | 60 | 3 |
| 7 | None | 25 | 60 | 48 |

The process of the formation of the above-described accumulative coat layer was repeated 20 times, and the reproducibility was very good in each case. When the thus-obtained coated pattern was dipped in water of a temperature of 25° C. for 120 minutes, the pattern was easily dissolved out. The hardened product consisting of the accumulative coat layer was taken out of water and dried at room temperature, thereby easily obtaining a green mold.

The green mold was cut with a diamond cutter to obtain ten test pieces. Five pieces among them were used for the measurement of the strength of the green mold in a bending strength test, while the remaining five pieces were fired in an electric oven at 1,000° C. for 1 hour and then allowed to cool to normal temperature. The latter five pieces were used for the measurement of the strength of the fired mold in a bending strength test. As a result of the measurements, the bending strength of the green mold was 36.1 kg/cm$^2$ in average, and the bending strength of the fired mold ws 49.7 kg/cm$^2$ in average.

Immediately after the preparation, the binder (A) was preserved at the room temperature in a hermetic state for three months, and films were formed on a glass plate in the same way as in the above. As a result, good films were obtained. Furthermore, molds were obtained in the same way as in the above and bending strength was measured. The bending strength of the green mold was 35.8 kg/cm$^2$ and that of the fired mold was 52.0 kg/cm$^2$, respectively. Thus, it was recognized that the preservation of the binder (A) was very good.

EXAMPLE 2

An aqueous silicasol containing 30 wt % of $SiO_2$ was used as a binder (J). 1,000 parts by weight of the binder (J), 3,500 parts by weight of Zircon Flour #200, 0.3 part by weight of a surfactant and 0.03 part by weight of an antifoaming agent were uniformly mixed to obtain a slurry ($J_1$). Separately from this, a water-soluble pattern was formed in the same way as in Example 1.

The water-soluble pattern was dipped in the slurry ($A_1$) prepared in Example 1, taken out to be sanded with a stucco material of Zircon Sand #80, and dried in the air at a temperature of 25° C. and at 60% RH for 3 hours, whereby a first coat layer was formed on the water-soluble pattern. The pattern having the first coat layer formed thereon was then dipped in the slurry ($J_1$), taken out to be sanded with the same stucco material as that used in forming the first coat layer, and dried under the same conditions, thereby forming a second coat layer. Subsequently, a third coat layer was formed by dipping the pattern in the slurry ($J_1$), taking it out to subject it to sanding with a stucco material of chamotte sand having a particle diamter of 0.5 mm, and drying it in the air at a temperature of 25° C. and 60% RH for 24 hours. Thus, an accumulative coat layer consisting of three layers was formed on the water-soluble area pattern.

About ⅔ of the coat layer portion of the pattern was dipped in water at 25° C. for 10 minutes while keeping the pattern portion out of contact with the water. After the pattern taken out of the water was dried in the air at normal temperature for 48 hours, the surface of the coat layer was observed. No feather-like crystals were found, which proved that the water resistance of the first coat layer was very good.

Separately from the above experiment, the coated pattern was wholly dipped in water at 25° C. for 30 minutes to dissolve out the pattern. A hardened body consisting of the accumulative coat layer was taken out and dried in the air at room temperature for 48 hours, thereby obtaining a green mold. The green mold was broken and the state of the surface which had been in contact with the pattern before the removal thereof and the state of the opposite surface thereof, namely, the surface of the third coat layer were observed with the naked eye, with the result that both surfaces observed were uniform without any defect. Furthermore, it was proved as a result of a hand-touch test that the hardness of the surface of the green mold which had been in contact with the pattern was sufficiently high.

EXAMPLE 3

A water-soluble area powder was molded in a metal mold at a temperature of 130° C. to 140° C. and under a pressure of 150 kg/cm$^2$ to obtain a water-soluble pattern. This water-soluble pattern was combined with other pattern parts for a runner and a gate, which had been separately formed from a water-soluble wax, with an adhesive, thereby producing a tree.

This tree was dipped in the slurry ($A_1$) prepared in Example 1 by using the binder (A) which had been preserved for 3 months, taken out to be sanded with a stucco material of Zircon Sand #80, and dried in the air at a temperature of 25° C. and at 50% RH for 3 hours, so that a first coat layer was formed on the tree. Subsequently, the tree with the first coat layer formed thereon was dipped in the slurry ($J_1$) prepared in Example 2 and taken out. The tree was then sanded and dried in the same way as the above to form a second coat layer. Third to seventh layers were subsequently formed in the same way by using the slurry ($J_1$). The drying conditions were the same as the above with the exception that the drying time for the formation of the seventh layer was 48 hours. Regarding the stucco materials used in the sanding steps, chamotte sand having a particle diameter of 0.5 mm was used for the formation of the third and fourth coat layers; chamotte sand having a particle diameter of 1.0 mm was used for the formation of the fifth and sixth coat layer, and in the formation of the seventh layer the tree was directly dried without being subjected to sanding. No feather-like crystals were found on the surface of the accumulative coat layer on the pattern.

The coated tree obtained in this way was dipped in boiling water for 15 minutes to remove the pattern therefrom, and the hardened body consisting of the accumulative coat layer was taken out and dried in the air of a temperature of 100° C. for 1 hour to obtain a green mold. The inner surface of the green mold had a sufficient hardness and no surface roughness was observed at all. The green mold was next fired in an electric oven at 1,000° C. for 2 hours to obtain a fired mold, which was also quite free from any defect.

A molten metal of JIS SCS 13 (of 1,650° C.) was poured into the fired mold and was then allowed to cool. After the molten metal was cooled, the mold was broken to obtain a casting. The casting had a smooth surface and a high dimensional accuracy.

EXAMPLE 4 AND COMPARATIVE EXAMPLE 1

In the same manner as in Example 1, binders (B), (C), (D), (E) and (F) of the present invention having the following compositions were prepared, while binders (a), (b) (c) and (d) having the following compositions were prepared as comparative examples. The compositions are represented in terms of weight ratios. The binder (d) is a hydrolyzed solution of Ethyl Silicate 40.

| | | |
|---|---|---|
| (B) | Ethyl Silicate 40 | 1,500 |
| | Tetra n-butoxy zirconium | 383 |
| | Diethanolamine | 210 |
| | Xylene | 1,500 |
| (C) | Ethyl Silicate 40 | 1,500 |
| | Tetraisopropoxy titanium | 142 |
| | N—2-aminoethylethanolamine | 52 |
| | Toluene | 1,500 |
| (D) | Ethyl Silicate 40 | 1,500 |
| | Tetraisopropoxy titaneium | 43 |
| | Isopropanolamine | 22 |
| | Toluene | 1,500 |
| (E) | Ethyl Silicate 40 | 1,500 |
| | Tri sec-butoxy aluminum | 246 |
| | Ethanolamine | 61 |
| | Xylene | 1,500 |
| (F) | Ethyl Silicate 40 | 1,500 |
| | Tetraisopropoxy titanium | 454 |
| | Diethanolamine | 315 |
| | Toluene | 1,500 |
| (a) | Ethyl Silicate 40 | 1,500 |
| | Tetraisopropoxy titanium | 284 |
| | N—(2-aminoethyl)-3-amino-propyl trimethoxysilane | 222 |
| | Xylene | 1,500 |
| (b) | Ethyl Silicate 40 | 1,500 |
| | N—methylethanolamine | 75 |
| | Xylene | 1,500 |
| (c) | Ethyl Silicate 40 | 1,500 |
| | Tetraisopropoxy titanium | 284 |
| | Benzyl amine | 107 |
| | Xylene | 1,500 |
| (d) | Ethyl Silicate 40 | 748 |
| | Ethanol | 183 |
| | 0.4% hydrochlorlc acid | 69 |

The binder (A) prepared in Example 1, the binders (B) to (F) in accordance with the present invention and the binders (a) to (d) prepared for the comparative examples were applied to a glass plate immediately after the preparation and after 3 month's preservation in a hermetic state. They were dried in the air at a temperature of 25° C. and at 60% RH to measure the hardening time and to examine the presence of an order of amine. In addition, the pattern dissolving power of each of the binders was measured by dipping a water-soluble area pattern in each binder, taking it out after 24 hours and oberving the presence or absence of the binder corroding the surface of the pattern with the naked eye. The results are shown in Table 2.

TABLE 2

| | Immediately after preparation | | | After 3-month preservation | |
|---|---|---|---|---|---|
| Binder | Pattern dissolving powder | Odor of amine | Hardening time (min) | Odor of amine | Hardening time (min) |
| (A) | No | No | 40 | No | 42 |
| (B) | No | No | 16 | No | 17 |
| (C) | No | No | 35 | No | 37 |
| (D) | No | No | 18 | No | 20 |
| (E) | No | No | 60 | No | 62 |
| (F) | No | No | 20 | No | 20 |
| (a) | No | No | 20 | No | 60 |
| (b) | Yes | Yes | 10 | Yes | 10 |
| (c) | Yes | Yes | 14 | Yes | 16 |
| (d) | Yes | No | — | — | — |

The results shown in Table 2 show that all of the binders (A) to (F) of the present invention have a good stability, do not emit an odor of amine and do not dissolve the urea pattern.

COMPARATIVE EXAMPLE 2

By using the binder (a) in Comparative Example 1 immediately after the preparation and after 3-month preservation in a hermetic state, a green mold and a fired mold were made in the same way as in Example 1. The results of the measurements of the bending strength thereof are shown in Table 3.

TABLE 3

| Binder | Bending strength of a green mold (kg/cm$^2$) | Bending strength of a fired mold (kg/cm$^2$) |
|---|---|---|
| Immediately after preparation | 31.9 | 41.1 |
| After 3-month preservation | 19.8 | 26.8 |

When the results shown in Table 3 are compared with those in Example 1, it is found that a conventional binder after preservation considerably lowers the strength of a mold, while a binder of the present invention hardly changes the strength of a mold even after preservation, and enables a mold having a uniform quality to be manufactured.

EXAMPLE 5 AND COMPARATIVE EXAMPLE 3

Molds were made in the same way as in Example 2 by using the binder (B) obtained in Example 4 and the binders (b), (c) and (d) obtained in Comparative Example 1.

When the coated patterns having the respective three-layered accumulative coating layers were observed after the drying steps in the process of manufacturing the molds to examine the presence or absence of feather-like crystals, no feather-like crystals were found on the surface of the pattern using the binder (B), while feather-like crystals were found on the surfaces of the patterns using the binders (b), (c) and (d), these binders being proved to be poor in water resistance.

The green molds obtained in the same way as in Example 2 were broken to examine the hardness and the properties of the respective surfaces which had been in contact with the respective patterns. The surface hardness of any of the molds which used the binder (B) was proved to be high and free from any defect, while the surfaces of the molds which used the binder (b), (c) and (d) were soft and rough, thereby lacking in practicability.

In contrast, Example 5 shows that the water resistance of the first coat layer which comes into contact with a watersoluble pattern is greatly enhanced by using a binder of the present invention, and that even if an accumulative coat layer is formed thereon by using an aqueous silicasol binder, it is possible to obtain a mold which enables precision casting.

EXAMPLE 6 AND COMPARATIVE EXAMPLE 4

Molds were made and casting tests were carried out in the same way as in Example 3 by using the binder (B) prepared in Example 4 and the binders (a) and (b) prepared in Comparative Example 1, respectively.

Both manufacture of a mold and casting were good when using the binder (B), while feather-like crystals were found on the coated patterns using the binders (a) and (b), and a remarkable surface folding was observed in a casting obtained from these molds.

As a result of repetition tests, the mold using the binder (B) showed a good reproducibility. In contrast, in Comparative Example 4, one among the ten fired molds in total which used the binder (a) was broken during pouring molten metal, and five among the ten fired molds in total which used the binder (b) were broken during pouring.

As described above, according to the present invention, it is possible to produce an improved binder for manufacture of a precision casting mold very easily merely by mixing an alkyl silicate and an amino-alkoxide of titanium, zirconium, tin, aluminum or the like.

Since a binder of the present invention has an adjusted constant hardening speed and a good stability, it is possible to make a mold having a constant quality in a long-time use. In particular, when a mold is formed on a water-soluble pattern such as a urea pattern, the binder does not corrode the surface of the pattern, so that it is suitable for manufacturing a precision casting mold. In addition, in the operation of manufacturing a mold, the atmosphere is scarcely damaged by the odor of amine.

A binder of the present invention is sufficiently dried and hardened while absorbing the water in the air in the step of forming a coating layer on the surface of a pattern, and the strength of the hardened body is high, thereby facilitating the removal of the pattern. By firing the hardened body, it is easy to obtain a fired mold.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A binder for manufacture of a precision casting mold comprising a transparent solution containing an alkyl orthosilicate or an alkyl polysilicate having a polymerization degree of 2 to 10, and an amino-alkoxide of a metal selected from a group consisting of titanium, zirconium, tin and aluminum or a mixture thereof in a mol ratio (Si/N) of 0.01 to 1.0 calculated in terms of the silicon atom contained in the silicate and the basic nitrogen atom contained in the amino-alkoxide.

2. A binder according to claim 1, wherein said mol ratio (Si/N) is 0.03 to 0.5.

3. A binder according to claim 1, wherein said alkyl orthosilicate or alkyl polysilicate is methyl orthosilicate, ethyl orthosilicate, isopropyl orthosilicate, butyl orthosilicate, or ethyl polysilicate.

4. A binder according to claim 1, wherein said aminoalkoxide of a metal is an amino-alkoxide obtained by bringing a tetraalkoxide of titanium, zirconium or tin or a trialkoxide of aluminum, the alkoxy group of said tetraalkoxide or said trialkoxide having 1 to 8 carbon atoms, into ester exchange reaction with monoethanolamine, diethanolamine, triethanolamine, monoisopropanolamine, diisopropanolamine, triisopropanolamine, N-methylethanolamine, N-ethylethanolamine, N-n-butylethanolamine, N,N-dimethylethanolamine, N-(2-aminoethyl)ethanolamine, N-(2-hydroxyethyl)piperazine, aminoethyldiethanolamine, or 2-amino-2-methyl-1,3-propane-diol, and contains a total of not more than 6 oxygen atoms and basic nitrogen atoms in one molecule.

5. A binder according to claim 4, wherein said alkoxy group of said tetraalkoxide of titanium, zirconium or tin or said trialkoxide of aluminum contains 1 to 4 carbon atoms.

6. A binder according to claim 5, wherein said alkoxy group is a methoxy group, ethoxy group, isopropoxy group, n-butoxy group or an isobutoxy group.

7. A method of manufacturing a precision casting mold, comprising forming on a pattern a refractory coat layer comprising the binder according to claim 1, removing the pattern, and firing the refractory layer.

8. A precision casting mold manufactured by the method of claim 7.

* * * * *